United States Patent [19]

Al-Sabih

[11] Patent Number: 5,069,604

[45] Date of Patent: Dec. 3, 1991

[54] RADIAL PISTON ROTARY DEVICE AND DRIVE MECHANISM

[76] Inventor: Adel K. Al-Sabih, Post Office Box 1366 (Safat), Kuwait, Kuwait, 13014

[21] Appl. No.: 360,074

[22] Filed: Jun. 1, 1989

[51] Int. Cl.[5] ..... F01C 1/077

[52] U.S. Cl. ..... 418/36; 123/245; 74/435; 74/436

[58] Field of Search ..... 418/36, 38; 123/245; 74/435, 436

[56] References Cited

U.S. PATENT DOCUMENTS

| | | | |
|---|---|---|---|
| 2,046,989 | 7/1936 | Winter | 418/36 |
| 2,868,032 | 1/1959 | Miller | 74/436 |
| 3,381,669 | 5/1968 | Tschudi | 123/11 |
| 3,746,480 | 7/1973 | Ryen | 418/37 |
| 4,072,447 | 2/1978 | Gaspar | 418/36 |
| 4,174,930 | 11/1979 | Posson | 418/36 |
| 4,279,577 | 7/1981 | Appleton | 418/35 |
| 4,370,109 | 1/1983 | Sabet et al. | 418/34 |
| 4,419,057 | 12/1983 | Menioux | 418/36 |
| 4,553,503 | 11/1985 | Cena | 123/18 A |

FOREIGN PATENT DOCUMENTS

| | | | |
|---|---|---|---|
| 1211458 | 2/1986 | U.S.S.R. | 418/36 |

*Primary Examiner*—John J. Vrablik
*Assistant Examiner*—David L. Cavanaugh
*Attorney, Agent, or Firm*—Bacon & Thomas

[57] ABSTRACT

A radial piston rotary device is disclosed having a gear drive mechanism to convert the varying speed of rotating piston shafts into uniform rotational motion of a power shaft. The rotary device has a pair of radial pistons, each having diametrically opposed piston portions and each connected to concentric piston shafts. Each of the pistons is mounted within a housing so as to rotate about the longitudinal axis of the piston shafts. The drive system to convert the motion of the piston shafts to uniform rotational motion includes irregular gear sets operatively connected to each of the piston shafts. Each of the irregular gear sets has gear wheels with gear teeth segments extending over only a portion of their peripheries and also having different pitch diameters. The gear wheels are connected so as to rotate together, along with one of the radial pistons, as a unit. The other radial piston is connected to a separate irregular gear set having an identical construction. The drive ratios between the gear sets are alternated such that a "leading" piston drives the power shaft at a relatively constant speed.

15 Claims, 9 Drawing Sheets

RADIAL PISTON ROTARY DEVICE AND DRIVE MECHANISM

BACKGROUND OF THE INVENTION

The present invention relates to a radial piston rotary power device and a drive mechanism particularly suited for the unique characteristics of such a rotary device.

Radial piston rotary engines are well known in the art and typically comprise a pair of pistons, each having two radial piston portions extending in diametrically opposite directions from a central axis. The diametrically opposed piston portions rotate as a unit about the central axis and each radial piston is connected to a piston shaft. The piston shafts are typically arranged in concentric fashion about the rotational axis of the pistons.

When the device operates as a power source, pressured gas may be introduced between closely adjacent piston portions of the two rotary pistons so as to exert a force thereon tending to rotate the pistons in opposite directions. Means are typically provided to ensure that both of the rotary pistons rotate in only a single direction. Therefore, one of the piston portions, typically termed the "lagging" piston, will either remain stationary or will rotate in the given direction at a relatively small angular velocity while the gases exert sufficient force on the other radial piston, typically termed the "leading" piston, causing it to rotate about the central axis at a higher angular velocity to rotate the associated piston shaft.

As the opposite piston portion of the "leading" piston approaches the stationary or slowly moving "lagging" piston, the rotary pistons assume opposite functions i.e. the previously "lagging" piston now becomes the "leading" piston, while the opposite portion of the previous "leading" piston now becomes the "lagging" piston. By introducing or pressurizing the gas between these piston portions, the new "leading" piston will rotate about its axis so as to rotate its piston shaft.

Although the rotary devices per se have proven to be a simple and efficient way of providing power, they have not achieved their maximum acceptance due to the difficulties encountered in converting the varying rotational speeds of the piston shafts into uniform rotational motion. Many systems have been devised and tried over the years including ring and pinion drives, cam drives, ratchet mechanisms, scissor crank drives and linkage mechanisms. While all of these drive systems are theoretically functional, they have proven to be unduly complex and inherently unreliable and inefficient. Despite the numerous attempts, the problem of simply and reliably converting the varying rotational speed of the two piston shafts into uniform rotation of a power shaft remains unsolved.

SUMMARY OF THE INVENTION

A radial piston rotary device is disclosed having a gear drive mechanism to reliably and simply convert the varying rotational motion of the respective piston shafts into uniform rotational motion of a power shaft. The rotary device has a pair of radial pistons, each having diametrically opposed piston portions and each connected to concentric piston shafts. Each of the pistons is mounted within a housing so as to rotate about the longitudinal axis of the piston shafts.

The housing defines intake and exhaust ports to permit the introduction of a combustible gas, such as fuel/air mixture, into the housing and to permit the spent gases to exhaust from the interior of the housing. An ignition element, such as a spark plug or fuel injector, extends into the interior of the housing and may be located approximately diametrically opposite the intake and exhaust ports.

It is envisioned that the rotary engine will operate in a four cycle mode and that the relative movement of the radial pistons will provide the requisite intake, compression, ignition/power and exhaust "strokes" in the normally sequential manner.

The drive system to convert the motion of shafts to uniform rotational motion includes a modified irregular gear set operatively connected to each of the piston shafts. Each of the irregular gear sets has first and second gear wheels, each with gear teeth segments extending over only a portion of their peripheries and also having different pitch diameters. The gear wheels are connected so as to rotate together, along with one of the radial pistons, as a unit. The other radial piston is connected to a separate irregular gear set having an identical construction.

Each gear set also includes third and fourth gear wheels, each of which also has gear teeth segments extending over only a portion of the periphery. The third and fourth gear wheels have different pitch diameters and the gear teeth segments are adapted to engage those of the first and second gear teeth segments, respectively. A power shaft interconnects the third and fourth gear wheels of both of the irregular gear sets such that they rotate as a unit.

In operation, the irregular gear sets allow the "leading" piston to drive the power shaft at a given angular velocity. The gear set connected to the "lagging" piston has a lower drive ratio than the gear set connected to the "leading" piston to prevent reverse rotation of the "lagging" piston while at the same time rotating it at a slower angular velocity than that of the "leading" piston.

Shortly before the "lagging" piston becomes the "leading" piston for the subsequent power stroke, means are provided to shift the ratios of the irregular gear sets. Thus, once the "lagging" piston becomes the "leading" piston, its irregular gearset will shift to the higher drive ratio to allow the piston to travel at a higher angular velocity than that of the now "lagging" piston. The gearset of the new "lagging" piston similarly shifts to the lower drive ratio so as to lower the angular velocity of the "lagging" piston.

The ratio shift ensures that the power shaft is always driven by the "leading" piston at a relatively constant angular velocity.

The invention also encompasses a system to synchronize the rotational movement of the irregular gears so as to provide a smooth engagement between the various gear teeth segments. During the changeover from the higher or lower drive ratios, a pin and slot system on the gear wheels provides the driving engagement between them. The synchronizing slot is shaped so as to provide a smooth transition between the drive ratios and to stabilize the relative speed between the gear wheels prior to engagement of the gear teeth segments.

DETAILED DESCRIPTION OF THE PREFERRED EMBODIMENT

Figure 1:
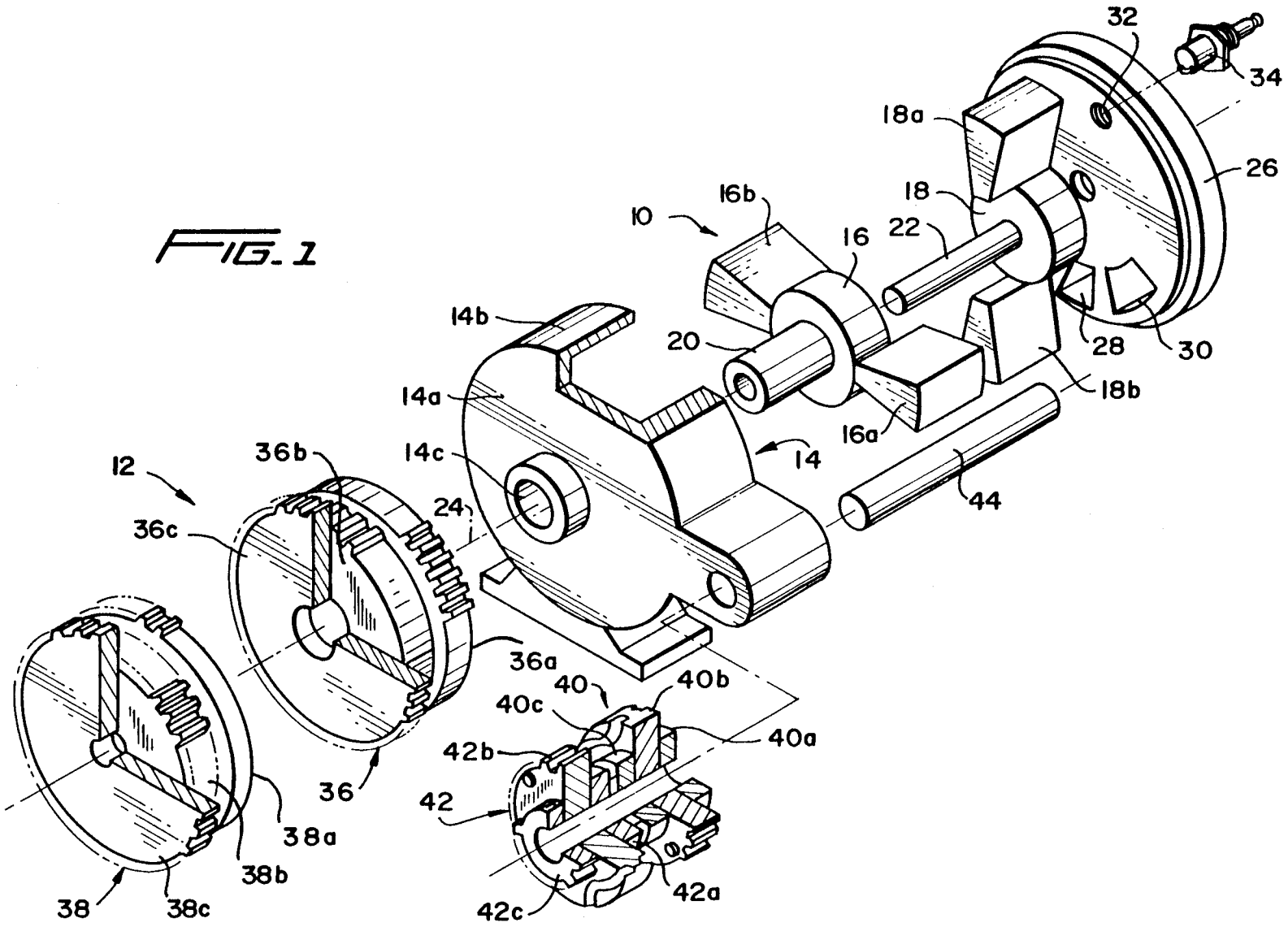
FIG. 1 is an exploded, perspective view of the radial piston device and the associated drive mechanism according to the invention.

The overall structure of the device according to the invention is best illustrated in FIG. 1 and comprises generally a radial piston rotary device 10 and an associated drive mechanism 12. The radial piston rotary device 10 will be described and illustrated as being powered by an internal combustion process of the four-cycle type. However, it should be understood that the structure of the invention may utilize compressed gas, such as air, steam, etc. as a driving force and also that the structure is equally applicable to a liquid meter, a metering pump for liquids, a compressor, vacuum pump, suction pump, etc.

The radial piston rotary device 10 comprises a housing 14 with a front wall 14*a* and an outer wall 14*b* defining a generally cylindrical chamber. A pair of radial pistons 16 and 18 are rotatably supported within the chamber by connection with piston shafts 20 and 22, respectively. Piston shafts 20 and 22 are concentrically arranged so as to rotate about axis 24 and to extend through opening 14*c* exteriorly of housing 14.

Radial pistons 16 and 18 have radial piston portions 16*a* and 16*b*, and 18*a* and 18*b* radially extending therefrom in diametrically opposite positions.

Rear wall 26 is attachable to housing 14 so as to enclose the pistons 16 and 18 within the chamber defined by the housing. Rear wall 26 may also define fuel/air intake port 28, exhaust port 30 as well as ignition opening 32 which accommodates a spark plug 34 in the known fashion.

Figure 2:
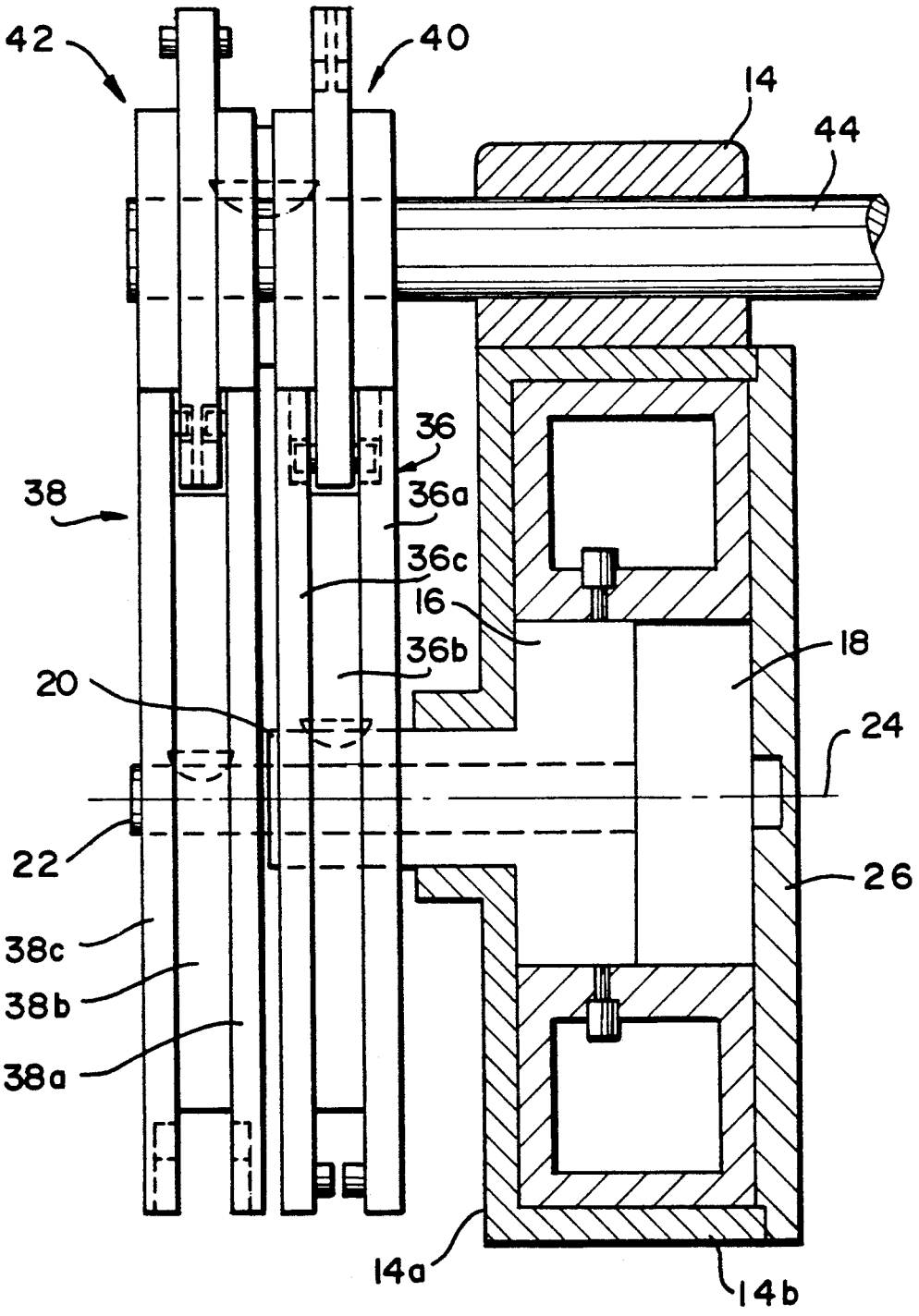
FIG. 2 is a side view, partially in section, of the device shown in FIG. 1.

As best seen in FIG. 2, the radial piston portions 16*a*, 16*b*, 18*a* and 18*b* are each of such longitudinal dimension that they substantially occupy the entire longitudinal space between front wall 14*a* and rear wall 26 and also radially extend outwardly so as to be closely adjacent to outer wall 14*b*. Although the dimensions may be controlled such that no additional sealing means may be necessary between the respective walls and the radial pistons, the use of such known sealing means to prevent the transfer of gases between the respective radial pistons and the walls may be utilized without exceeding the scope of this invention. Also, piston shaft 20 and the rear portion of piston 18 may be rotatably supported in their respective housings by known bearing means.

Drive mechanism 12 comprises gear drive elements 36 and 38 which drivingly engage gear drive elements 40 and 42, respectively, which are both rigidly attached to power shaft 44. Power shaft 44 may be rotatably supported in an extension of housing 14 and may be connected to means (not shown) utilizing the rotational motion of the power shaft.

Figure 3:
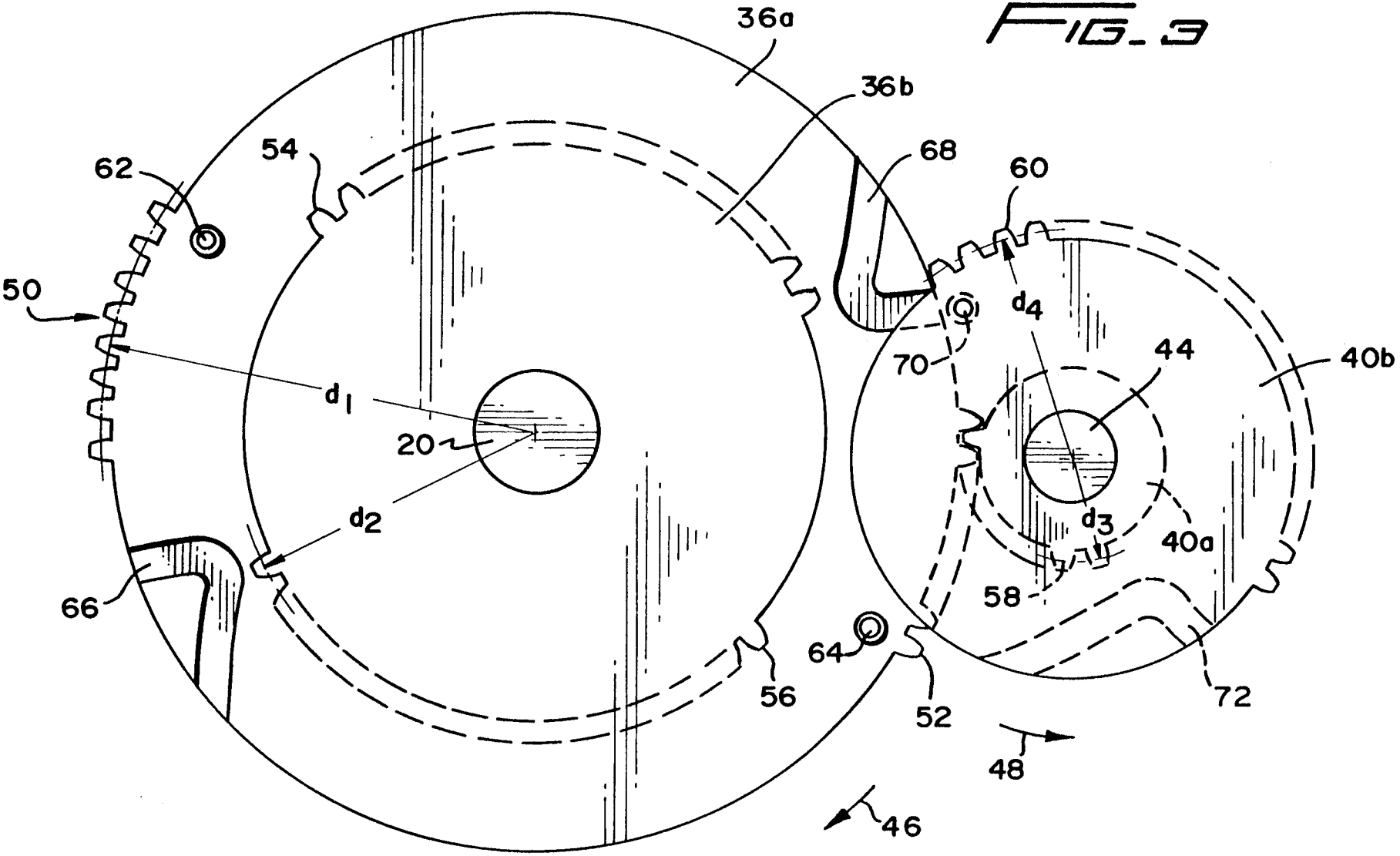
FIGS. 3–7 are front views of one of the gear drive means according to the invention illustrating the sequence of operation of the synchronizing system during the change in gear drive ratios.

Gear drive element 36 comprises a first gear wheel 36*a* having gear teeth on only a portion of its periphery with a pitch radius of $d_1$, and a second gear wheel 36*b* having second gear teeth segments extending over only a portion of its periphery with a pitch radius $d_2$. As illustrated in FIG. 3, $d_2$ is less than $d_1$. An additional gear wheel 36*c* may also be included in the drive gear element 36 having dimensions and gear teeth similar to gear wheel 36*a*, for the purpose of balancing forces and distribution.

Drive gear element 38 is similarly configured having gear wheel 38*a* with gear teeth segments extending over only a portion of its periphery with a pitch radius of $d_1$ and gear wheel 38*b* having gear teeth segments extending over only a portion of its periphery with a pitch radius of $d_2$ such that the $d_2 < d_1$. Gear wheel 38*c*, having dimensions and teeth coinciding with gear wheel 38*a* may also be included, for force balancing and distribution.

The gear wheels of the respective gear drive elements 36 and 38 are fixedly attached to piston shafts 22 and 20, respectively, such that the gear wheels rotate as a unit with their respective pistons.

Drive gear element 40 has a third gear wheel 40*a* having a gear teeth segment extending over only a portion of its periphery with a pitch radius of $d_3$, the teeth being positioned so as to engage the gear teeth segments formed on gear wheel 36*a*. Gear wheel 40*b* also has a gear teeth segment extending over only a portion of its periphery with a pitch radius of $d_4$ such that $d_4$ is greater than $d_3$ with the teeth of the fourth gear segment being located so as to engage the gear teeth segments formed on gear wheel 36*b*. Gear wheel 40*c*, having dimensions and gear teeth similar to gear wheel 40*a* may also be incorporated so as to engage the gear teeth formed on gear wheel 36*c*, for force balancing and distribution.

Gear drive element 42 is configured similarly to gear drive element 40 and comprises gear wheel 42*a*, again having a gear teeth segment extending over only a portion of its periphery with a pitch radius of $d_3$ and located so as to engage the teeth of gear segments on gear wheel 38*a*. Gear wheel 42*b* has a gear teeth segment extending over only a portion of its periphery with pitch radius of $d_4$ such that $d_4$ is greater than $d_3$ wherein the teeth are located so as to engage the teeth of the gear segment formed on the gear wheel 38*b*. Again, gear wheel 42*c* may be incorporated having dimensions and gear teeth similar to gear wheel 42*a* and adapted to engage the teeth formed on gear wheel 38*c*for force balancing and distribution.

Gear drive elements 40 and 42 may be formed form as single unit or may be separately formed and attached to power shaft 44 so as to rotate as a unit.

The gear teeth on the respective gear wheels have not been shown in FIG. 1 for the purposes of clarity. However, the respective gear segments and their positions are clearly shown in FIG. 3–7 and 9–12. The interrelationship of the respective gear teeth as well as the device for synchronizing the movement of the gear wheel during the drive ratio change is illustrated in FIGS. 3–7. Since gear drive element 36 is identical to gear drive element 38, and gear drive element 40 is identical to gear drive element 42, only the relationships between gear drive elements 36 and 40 are shown in FIGS. 3–7. However, it is to be understood that the interrelationships between gear drive elements 38 and 42 are identical, however mounted out of phase, FIG. 9–12. Similarly, since gear wheel 36*c* is identical to gear wheel 36*a* and gear wheel 40*c* is identical to gear wheel 40*a*, gear wheels 36*c* and 40*c* have been omitted from FIGS. 3–7. In describing the operation of these elements, it will be assumed that gear wheels 36*a* and 36*b* rotate as a unit in the direction of arrow 46, while gear wheels 40*a* and 40*b* rotate as a unit in the direction of arrow 48.

As can be seen, each of the gear wheels is an irregular gear wheel in that the gear teeth extend over only a portion of the respective peripheries. Gear wheel 36*a* has gear teeth segments 50 and 52 located at generally diametrically opposite positions on the wheel, each having a pitch radius $d_1$. Gear wheel 36*b* also has generally diametrically opposed gear teeth segments 54 and 56, each having a pitch radius $d_2$ such that $d_2 < d_1$. Similarly, gear wheel 40*a* has a gear teeth segment 58 with a pitch radius of $d_3$. Gear wheel 40*b* has gear teeth segment 60 with a pitch radius of $d_4$ such that $d_4 > d_3$. Gear teeth segment 58 is adapted to engage the gear teeth segments 50 and 52, while gear teeth segment 60 is adapted to engage gear teeth segments 54 and 56.

As will be explained in more detail hereafter, rotation of piston shaft 20 causes the rotation of gear wheels 36*a* and 36*b* in the direction of arrow 46. At the point in the cycle shown in FIG. 3, gear teeth segments 52 and 58 are in driving relationship so as to rotate the power shaft 44 with a drive ratio of $R_1$ which is equal to $d_3/d_1$. Continued rotation of the elements in directions 46 and 48, respectively, will cause the disengagement of gear segments 52 and 58 and the engagement of gear teeth segments 60 and 54. At this point, the drive ratio will change to at a second drive ratio $R_2$ which is equal to $d_4/d_1$. As can be seen, drive ratio $R_2$ will be greater than drive ratio $R_1$.

Further rotation of the gear wheels will bring gear teeth segment 50 into engagement with gear teeth segment 58 following the disengagement of gear teeth segments 54 and 60. Continued rotation will disengage gear teeth segments 50 and 58 and will bring gear teeth segment 56 into engagement with gear teeth segment 60.

Means are provided on the respective gear wheels to synchronize their rotational movement during the period of time between the disengagement of one pair of gear teeth segments and the engagement of the next following pair of gear teeth segments to provide a smooth engagement of these gear teeth segments and to minimize any shock imparted to them or to the drive system. The synchronizing system comprises a drive pin or roller from one of the gear wheels and a slot in another one of the gear wheels such that the engagement of the pin and slot provides the driving engagement between the wheels from disengagement of one pair of gear teeth segments until the engagement of the next gear teeth segments. As illustrated in FIGS. 3–7, the synchronizing system comprises drive pins 62 and 64 extending from gear wheel 36*a*, which also defines slots 66 and 68. Drive pin 70 extends laterally from gear wheel 40*b*, which also defines slot 72.

Figure 4:
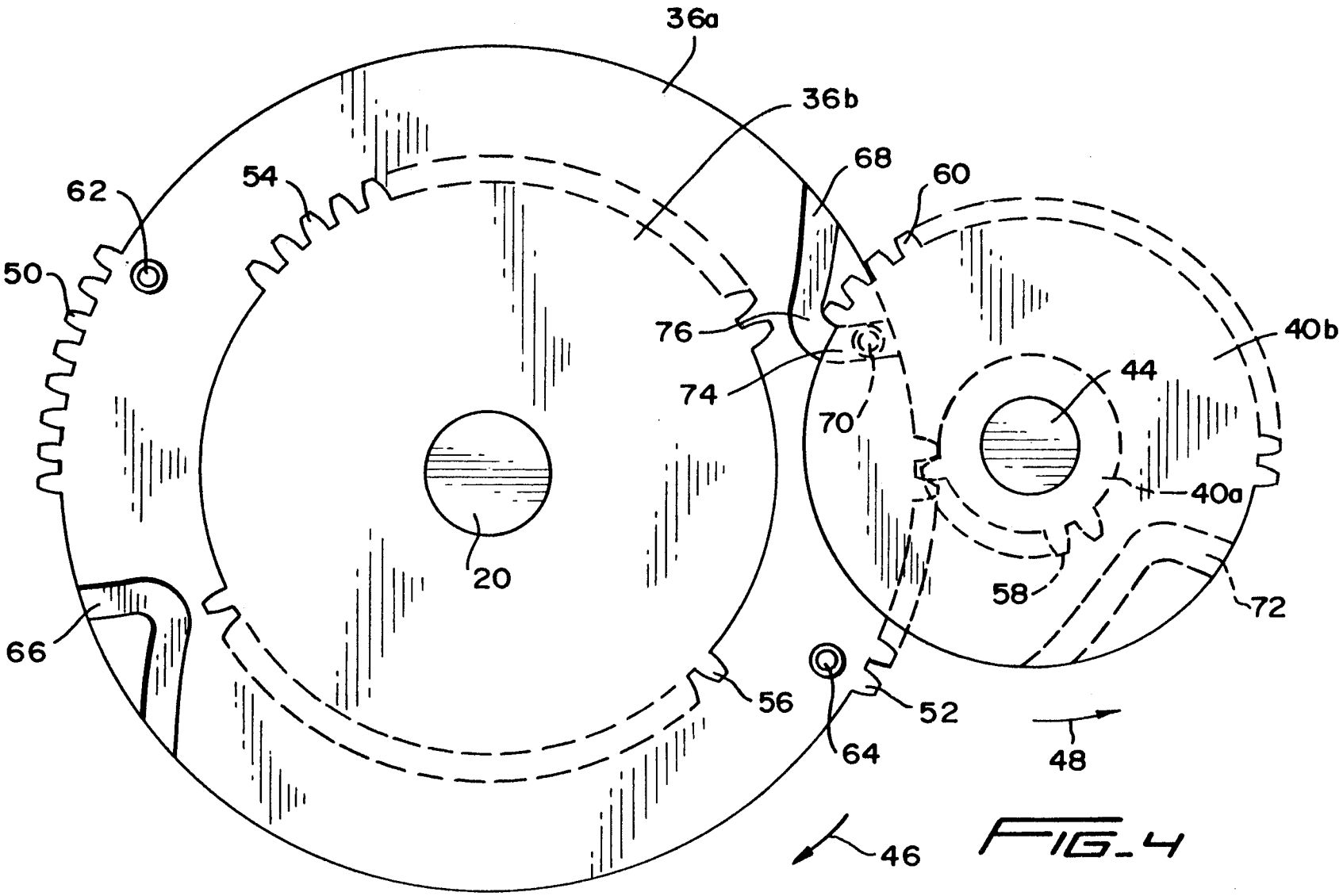

The operation of the synchronizing device will be described in conjunction with drive pin 70 and slot 68, however, it is to be understood that the operation of the remaining drive pins and slots is identical. In FIG. 3, gear teeth segments 52 and 58 are still in driving engagement and pin 70 has not, at this point, entered slot 68. In FIG. 4 gear teeth segments 52 and 58 are still in driving engagement while the drive pin 70 has passed through an entrance portion of the slot 68. The drive ratio provided between the pin and the slot at this point must, of course, be the same as that provided by the interengagement of the gear teeth 52 and 58.

Continued rotation of the gear wheels will disengage gear teeth segments 52 and 58 such that the interengagement of pin 70 with slot 68 will provide the sole driving connection between gear wheels 36*a* and 40*b*. At the point that the gear teeth segments 52 and 58 are completely disengaged, the pin will be at approximately point 74 in slot 68. From this point 74 until point 76 at the innermost portion of slot 68, the slot defines a transition portion which changes the drive ratio between the gear wheels to match that of the next engaging gear teeth segments, in this particular case gear teeth segments 54 and 60. This ensures that the gear teeth segments 54 and 60 will mesh cleanly and will minimize the shock of such engagement to the gear teeth or the gear wheels.

Figure 5:
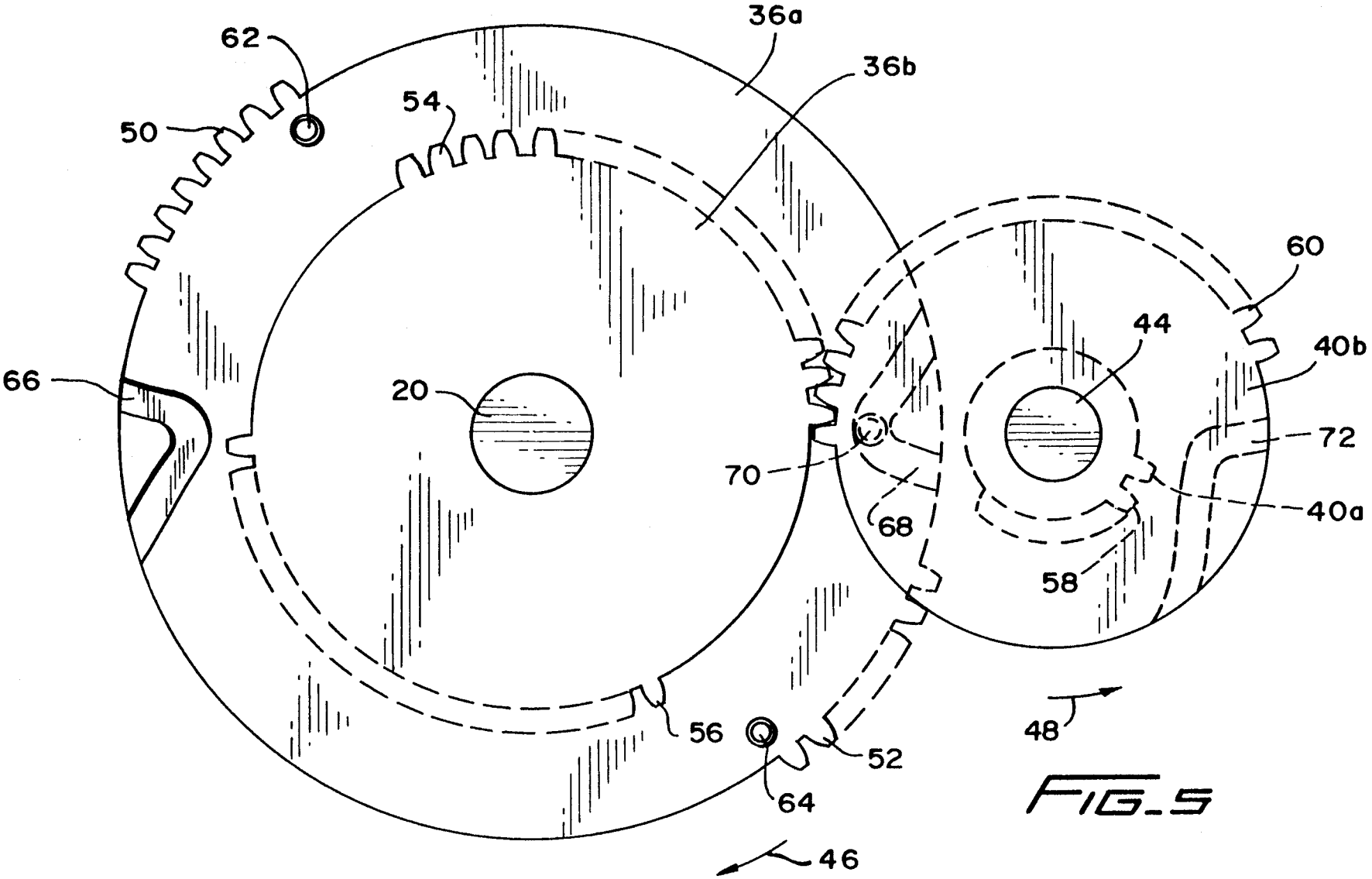
Figure 6:
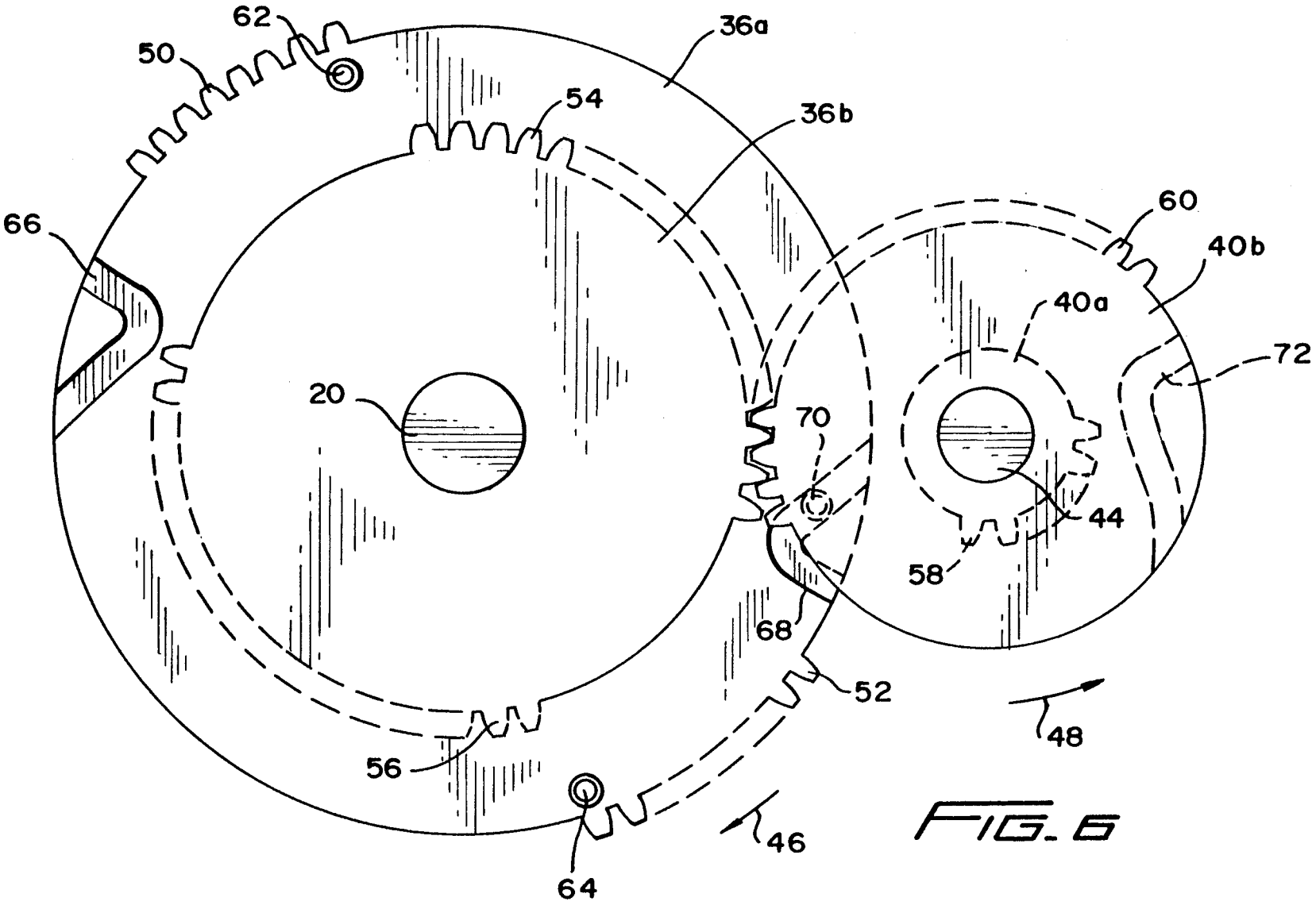
Figure 7:
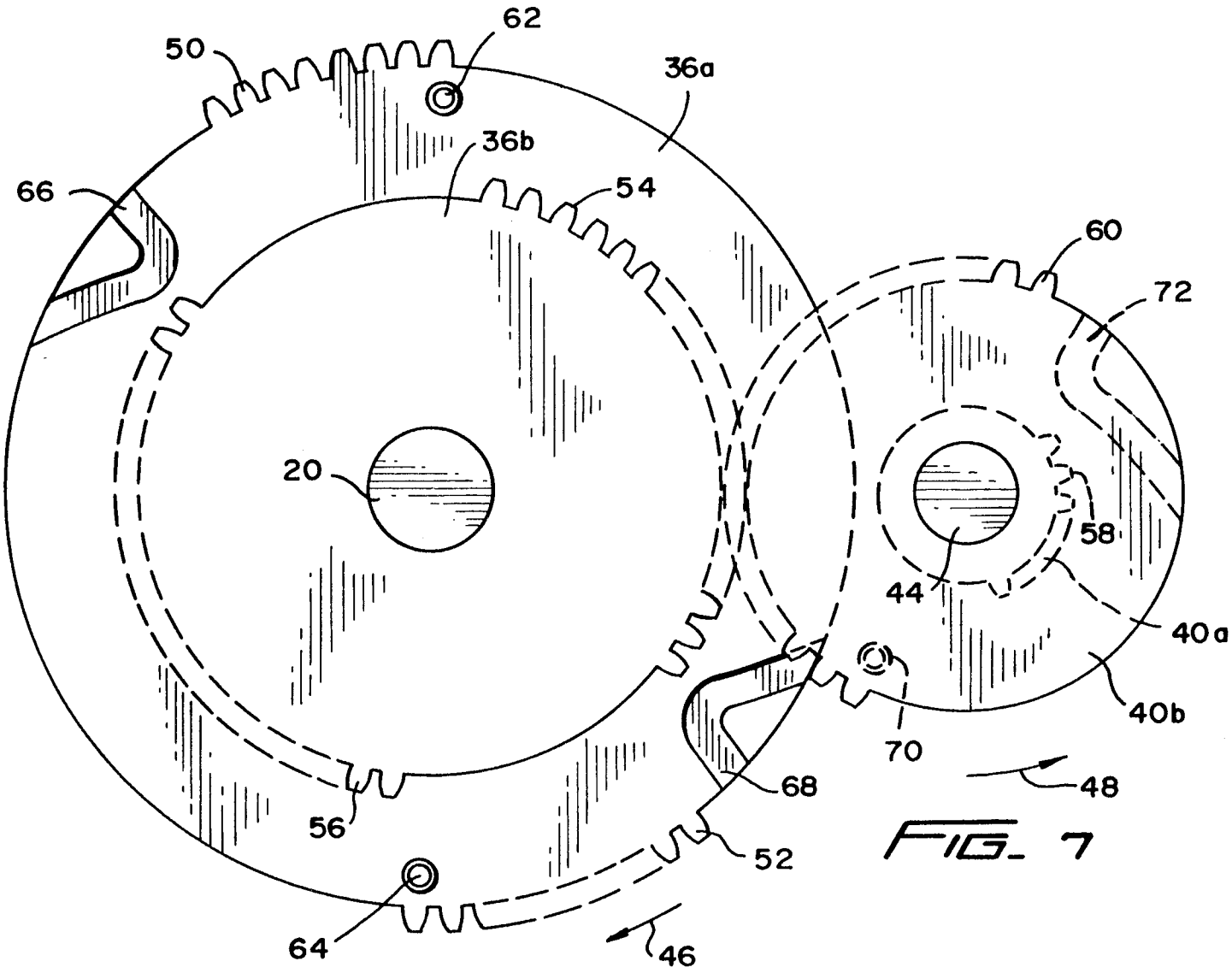
Figure 8:
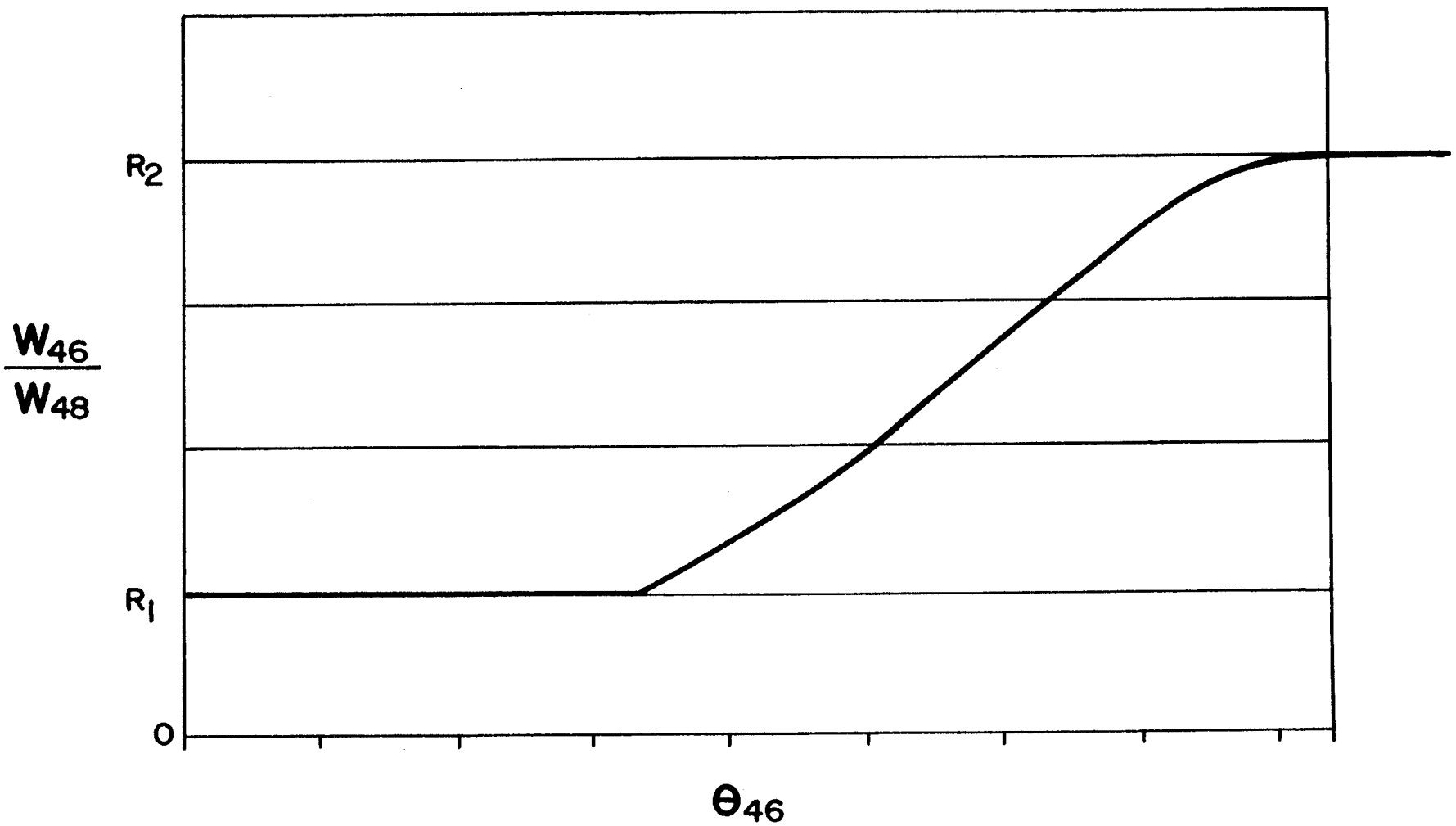
FIG. 8 is a graph showing the drive ratio change between $R_1$ and $R_2$.

In FIG. 5, drive pin 70 has reached the end of the transition zone at point 76 in slot 68 and gear teeth segments 54 and 60 are now in driving engagement with each other. Slot 68 also defines an exit portion which allows pin 70 to pass through the slot without exerting any additional driving force between the wheels, since the gear teeth segments 54 and 60 are in driving engagement at this point. The passage of the pin 70 through the exit portion of the slot 68 is illustrated in FIG. 6. Continued rotation of the gear wheels will remove pin 70 from the slot 68 as illustrated in FIG. 7. The drive wheels continue to rotate with the driving engagement of gear teeth segments 54 and 60 until the engagement of drive pin 62 with slot 72 which changes the drive ratio to provide a smooth engagement for the gear teeth segments 50 and 58. The transition portions of the slots provide a smooth transition between one drive ratio and the other, as graphically illustrated in FIG. 8.

The operation of the radial piston rotary device in conjunction with the drive mechanism will now be described with reference to FIGS. 9–12. In these figures, the gear drive elements 36 and 38 are schematically illustrated along with gear drive elements 40 and 42, but gear wheels 36*c*, 38*c*, 40*c* and 42*c* have been eliminated for the purposes of clarity. As can be seen, gear wheel 38*a* has gear teeth segments 78 and 80 identical to the previously described gear teeth segments 50 and 52 on gear wheel 36*a*. Gear wheel 38*a* also had drive pins 82 and 84, and defines slots 86 and 88.

Similarly, gear wheel 38*b* has gear teeth segments 90 and 92 whose function is identical to gear teeth segments 54 and 56 of gear wheel 36*b*. Gear wheel 42*a* has gear teeth segment 96, identical in function to gear teeth segment 58, while gear wheel 42*b* has gear teeth segment 96 identical in configuration to gear teeth segment 60. Gear wheel 42*b* has drive pin 98 and defines slot 100 whose function and structure are identical to drive pin 70 and slot 72 formed in gear wheel 40*b*.

Figures 9, 10, 11, 12:
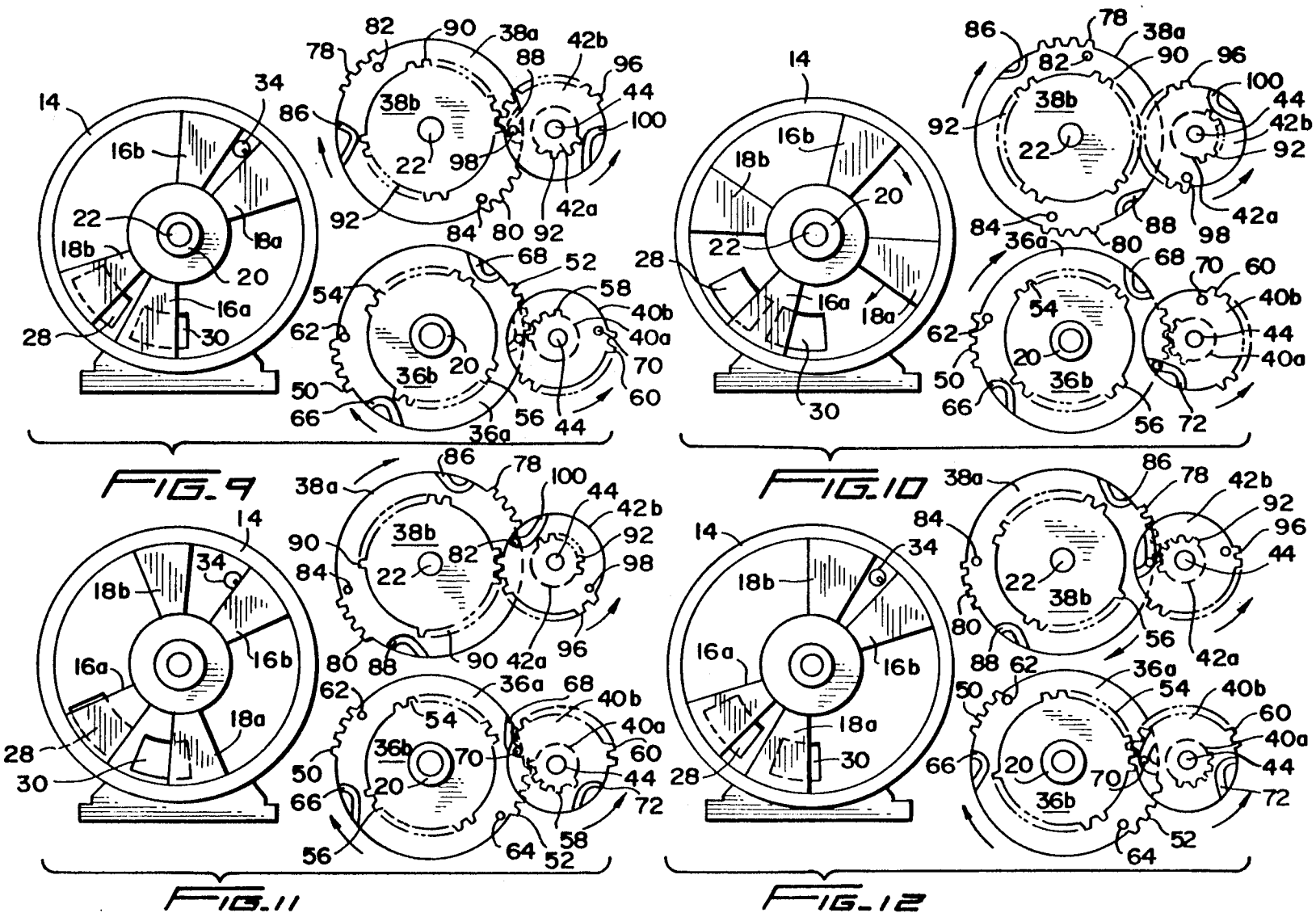
FIGS. 9–12 illustrate the operation of the motor and the positions of the gear drive wheels during a typical operational sequence according to the invention.

In the positions of the elements in FIG. 9, piston portions 16*b* and 18*a* have compressed a fuel/air mixture between them, which mixture is about to be ignited by spark plug 34. In the gear drive elements, gear teeth segments 52 and 58 are in driving engagement with each other, as are gear segments 90 and 96.

As the gas between piston portions 16*b* and 18*a* expand, it exerts a force on the pistons tending to move piston portion 18*a* in a clockwise direction, as illustrated in FIG. 10. Piston 18 is drivingly connected with gear drive element 38 though piston shaft 22. Gear drive element 38 is in driving engagement with gear drive element 42 by way of gear teeth segments 90 and 96, operating at a drive ratio of $R_2$. At the same time, piston 16 is connected with gear drive unit 36 through piston shaft 20. Gear drive element 36 is in operative engagement with gear drive element 40 through the engagement of gear teeth segments 52 and 58, operating at a drive ratio $R_1$ which is less than $R_2$. Since gear drive elements 40 and 42 are both connected to power shaft 44, they must operate at the same rotational speed. Due to the differences in the drive ratios $R_1$ and $R_2$, piston 18 will rotate at a higher angular velocity than will piston 16. The lower drive ratio $R_1$ between gear wheels 40*a* and 36*a* causes piston 16 to rotate in the same direction as piston 18, but at a slower angular velocity.

The difference in rotational speed between the pistons 16 and 18 will also compress a fuel/air mixture between piston portions 18*b* and 16*b*, while at the same time drawing in a fresh air/fuel mixture between piston portions 18*b* and 16*a* through intake port 28. Any burned gases between piston portions 16*a* and 18*a* from a previous operational cycle will be directed outwardly through exhaust port 30. As shown in FIG. 10 piston portion 16*a* is located between the intake and exhaust ports 28 and 30 to prevent any direct communication between them.

As piston portion 18*a* approaches the end of the power stroke, as illustrated in FIG. 11, gear drive elements 38 and 42 approach the end of the engagement of gear teeth segments 90 and 96. Drive pin 82 enters slot 100 to change the drive ratio as previously discussed. Similarly, drive gear elements 36 and 40 also approach the end of the engagement of gear teeth segments 52 and 58. Drive pin 70 also enters slot 68.

Piston portion 18*b* continues to approach piston portion 16*b* so as to further compress the fuel/air mixture therebetween while piston portion 16*a* has substantially closed off the intake port 28.

As illustrated in FIG. 12, the position of the engine elements are substantially the same as in FIG. 9, except that piston portion 16*b* is now the "leading" piston. While piston portion 18*b* is now the "lagging" piston. At this point, the gear drive elements are positioned such that gear drive elements 36 and 40 are now in the higher drive ratio $R_2$ via the engagement of gear teeth segments 54 and 60, while drive gear elements 38 and 42 have fully shifted to the lower drive ratio $R_1$ by the engagement of gear teeth segments 78 and 92. Ignition of the fuel/air mixture between piston portions 18*b* and 16*b* will now cause piston 16 to rotate at a higher angular velocity than piston 18. Since the drive gear mechanisms have now shifted drive ratios, piston 16 drives the power shaft 44 at the same rate that it was driven by piston 18. Thus, by shifting the drive ratios between the two pistons, the angular velocity of the power shaft 44 remains substantially constant.

The differential rotation of piston 16 with respect to the slower moving piston 18 will compress the fuel/air mixture between piston portion 16*a* and 18*b*, while at the same time drawing in a fresh fuel/air charge between piston portions 16*a* and 18*a* through intake port 28. The burned gases between piston portions 16*b* and 18*a* are exhausted through exhaust port 30.

Although the gear teeth segments of drive gear elements 38 and 42 are identical in construction to those described in detail in regard to drive gear elements 36 and 40, it should be noted that such gear teeth segments are circumferentially offset from their corresponding gear teeth segments in drive gear elements 36 and 40. This ensures that drive gear elements 38 and 42 are, at all times, operating at a different drive ratio than are drive gear elements 36 and 40.

The foregoing description is provided for illustrative purposes only and should not be construed as in any way limiting this invention, the scope of which is defined solely by the appended claims.

I claim:

1. A mechanism for synchronizing the rotation of a pair of gear wheels having pairs of inter-engaging teeth on only a portion of their peripheries comprising:

a) a pin or roller means extending from each of the gear wheels; and, b) a synchronizing slot defined by each of the gear wheels generally diametrically opposite the respective pin such that engagement of the pin and the synchronizing slot provides the sole driving connection between the gear wheels between disengagement of one pair of gear teeth segments and engagement of the next pair of gear teeth segments.

2. The mechanism according to claim 1 wherein each synchronizing slot defines a transition portion such that, during engagement of the pin with the transition portion of the slot, the relative angular velocity between the gear wheels is varied.

3. The mechanism according to claim 2 wherein each synchronizing slot further defines an entrance portion before the transition portion and an exit portion after the transition portion.

4. A drive system for a rotary piston device having first and second pairs of radial pistons rotatable about an axis, comprising:

a) first and second gear means operatively connected to the first and second pair of radial pistons respectively, each gear having drive ratios $R_1$ and $R_2$ such that $R_1 \neq R_2$ wherein each first and second gear means comprises:

i) a first gear wheel having a first gear teeth segment extending over only a portion of its periphery and having a pitch radius $d_1$;

ii) a second gear wheel having second gear teeth segment extending over only a portion of its periphery and having a pitch radius $d_2$ such that $d_2 < d_1$;

iii) means operatively connecting to the first and second gear wheels to one of the pair of radial pistons such that the elements rotate as a unit;

iv) a third gear wheel having a third gear teeth segment extending over only a portion of its periphery and having a pitch radius $d_3$, the third gear teeth segment located so as to engage the first gear teeth segment;

v) a fourth gear wheel having a fourth gear teeth segment extending over only a portion of its periphery and having a pitch radius $d_4$ such that $d_4 > d_3$, ; the fourth gear teeth segment located so as to engage the second gear teeth segment; and, vi) means operatively connecting the third and fourth gear wheels such that the elements rotate as a unit;

b) power shaft means interconnecting the third and fourth gear wheels;

c) means to shift the drive ratios of the first and second gear means between $R_1$ and $R_2$ such that when the first gear means has drive ratio $R_1$ the second gear means has drive ratio $R_2$ and vice versa; and, d) means to synchronize rotation of the first and second gear wheels with that of the third and fourth gear wheels to provide a smooth engagement of the respective gear teeth segments comprising:

i) at least one drive pin or roller extending from each of the first and fourth gear wheels; and, ii) at least one synchronizing slot defined by each of the first and second gear wheels located generally diametrically opposite the respective pin or roller such that at least one pin engages at least one slot before engagement of the next subsequent pair of gear teeth segments and provides the sole driving connections between the first and fourth gear wheels after disengagement of the pair of gear segments and before engagement of another pair of gear segments.

5. The drive system according to claim 1 wherein the first and second gear teeth segments are circumferentially displaced from each other, and the third and fourth gear teeth segments are circumferentially displaced from each other such that the first and third gear teeth segments are not engaged at the same time the second and fourth gear teeth segments are engaged and vice versa.

6. The drive system according to claim 5 wherein the gear teeth segments of the first gear means are circumferentially displaced from the corresponding gear teeth segments of the second gear means such that when the first and third gear teeth segments of one gear means are engaged, the second and fourth gear teeth segments of the other gear means are engaged and vice versa.

7. The drive system according to claim 4 wherein each synchronizing slot defines a transition portion to alter the relative rotational velocity between the first gear wheel and the fourth gear wheel, located such that the at least one pin enters the transition portion after disengagement of the previous gear teeth segments.

8. The drive system according to claim 7 wherein the engagement of the at least one pin with the at least one slot provides the sole driving connection between the first and second, and third and fourth gear wheels when the pin is in the transition portion.

9. A radial piston rotary device comprising:

a) a housing;

b) at least one pair of radial piston means located in the housing so as to rotate about an axis, the pair comprising a leading piston and a lagging piston;

c) drive means operatively connected to each of the radial pistons each drive means comprising:

i) first drive gear means having a drive ratio of $R_1$ comprising:

a) a first gear wheel having a first gear teeth segment extending over only a portion of its periphery and having a pitch radius $d_1$; and, b) a third gear wheel having a third gear segment extending over only a portion of its periphery and having a pitch radius $d_3$, the third gear teeth segments adapted to engage the first gear teeth segment;

ii) second drive gear means having a drive ratio of $R_2$ such that $R_2 > R_1$ comprising;

a) a second gear wheel having second gear teeth segment extending over only a portion of its periphery and having a pitch radius $d_2 < d_1$; and, b) a fourth gear wheel having a fourth gear teeth segment extending over only a portion of its periphery and having a pitch radius $d_4$ such that $d_4 > d_3$, the fourth gear teeth segment adapted to engage the second gear teeth segment;

d) means to synchronize rotation of the first and second gear wheels with that of the third and fourth gear wheels such that the drive means operatively connected to the lagging piston operates at the drive ratio of $R_1$, to rotate the lagging piston at an angular velocity of $\omega_1$ while the drive means operatively connected to the leading piston operates at the drive ratio of $R_2$ to allow the leading piston to rotate an angular velocity of $\omega_2$ such that $\omega_2 > \omega_1$, the synchronizing means comprising:

i) at least one pin or roller extending from each of the first and fourth gear wheels; and, ii) at least one synchronizing slot defined by each of the first and fourth gear wheels located such that the at least one pin engages the at least one slot before engagement of the next subsequent pair of gear teeth segments and provides the sole driving connection between the first and fourth gear wheels after disengagement of one pair of gear segments and before engagement of the next pair of gear segments.

10. The radial piston rotary device according to claim 9 further comprising:

a) intake port means defined by the housing adapted to permit entry of a combustible gas into the housing;

b) means to ignite the combustible gas between the leading and lagging pistons; and, c) exhaust port means defined by the housing adapted to allow burned gas to exit from the housing.

11. The radial piston rotary device according to claim 10 wherein the radial piston means comprises:

a) first and second radial pistons adapted to rotate about an axis as a unit, the radial pistons being substantially coplanar and located on opposite sides of the axis; and b) third and fourth radial pistons adapted to rotate about the axis as a unit, the third and fourth radial pistons being substantially coplanar and located on opposite sides of the axis.

12. The radial piston rotary device according to claim 11 wherein the housing is generally cylindrical and wherein the ignition means is located generally diametrically opposite from the intake and exhaust port means.

13. The drive system according to claim 14 wherein the first and second gear teeth segments are circumferentially displaced from each other and the third and fourth gear teeth segments are circumferentially displaced from each other such that the first and third gear teeth segments are not engaged at the same time the second and fourth gear teeth segments are engaged and vice versa.

14. The drive system according to claim 13 wherein the gear teeth segments of one of the drive means are circumferentially displaced from the corresponding gear teeth segments of the other drive means such that when the first and third gear teeth segments of one drive means are engaged, the second and fourth gear teeth segments of the other drive means are engaged and vice versa.

15. The drive system according to claim 9 wherein each synchronizing slot defines a transition portion to alter the relative rotational velocity between the first gear wheel and the fourth gear wheel located such that the at least one pin enters the transition portion after disengagement of the previous gear teeth segments.

* * * * *